United States Patent [19]

Hong

[11] Patent Number: 4,468,894

[45] Date of Patent: Sep. 4, 1984

[54] ELECTRICALLY DRIVEN KNIFE WHETTING MACHINE

[76] Inventor: Kee S. Hong, #16-84, Hoegi-dong, Tongdaemun-ku, Seoul, Rep. of Korea

[21] Appl. No.: 337,726

[22] Filed: Jan. 7, 1982

[30] Foreign Application Priority Data

Jan. 13, 1981 [KR] Rep. of Korea ..... 81-179
Aug. 11, 1981 [KR] Rep. of Korea ..... 81-5607

[51] Int. Cl.[3] ..... B24B 3/54

[52] U.S. Cl. ..... 51/109 BS; 51/128; 51/268

[58] Field of Search ..... 51/98 BS, 102, 109 R, 51/109 BS, 128, 268, 285; 76/82.2, 85, 88, 89

[56] References Cited

U.S. PATENT DOCUMENTS

| | | | |
|---|---|---|---|
| 2,522,942 | 9/1950 | Gillen | 51/268 |
| 2,618,240 | 11/1952 | Haase | 51/109 R |
| 2,751,721 | 6/1956 | Smith | 51/128 |
| 2,949,709 | 8/1960 | De Angelis et al. | 51/128 |
| 3,334,446 | 8/1967 | Jager | 51/128 |
| 3,513,599 | 5/1970 | Habrich | 51/128 |

FOREIGN PATENT DOCUMENTS

| | | | |
|---|---|---|---|
| 1389215 | 4/1975 | United Kingdom | 51/128 |

*Primary Examiner*—Robert P. Olszewski
*Attorney, Agent, or Firm*—Goodman & Teitelbaum

[57] ABSTRACT

An electrically driven knife whetting machine including an electric motor having a rotating shaft, the electric motor being contained in a motor housing with the shaft extending out of the motor housing. A grindstone rotating assembly is securely mounted on the shaft, the assembly including a grindstone mounted on a grindstone holder with the grindstone having a grinding surface. A cylindrical upper cover is securely mounted on the motor housing. A knife blade regulating and guiding member is cylindrically shaped like an upside-down cup for receiving the grindstone therein, the cup having a knife blade guiding opening of a given angle and size provided in a cylindrical wall thereof, with the guiding opening being disposed above the grindstone. A spring member for elastically moving the cup relative to the upper cover so that the guiding opening can be moved up and down with respect to the grindstone, where the cup is prevented from being laterally rotated with respect to the upper cover.

9 Claims, 13 Drawing Figures

ELECTRICALLY DRIVEN KNIFE WHETTING MACHINE

The present invention relates to an improved knife whetting machine driven by an electric motor for sharpening safely, reliably and accurately knife blades such as kitchen knives, fruit knives, pocket knives and stationery knives etc., said knife whetting machine being characterized by a knife blade regulating or guiding means for uniformly maintaining the contact angle between the knife blade and the plane surface on the top of the grindstone and also regulating the contact pressure therebetween when placing the knives to be whetted onto said knife blade guiding and regulating means and pressing them downward onto the rotating grindstone together with said means.

Furthermore, said knife whetting machine of the present invention is characterized in that the rotating grindstone has a plane surface on the top thereof so that the knife blade can be contacted therewith at a very small angle.

To whet a knife on the grindstone is to sharpen its blade, but the knife whetting work requires in practice a skilled handicraft. As is well known, there are several requirements for the skill-fulness in whetting a knife, and the best method of the knife whetting is to stop grinding the knife blade just before overgrinding.

Furthermore, if the knife whetting work consists of a single motion, every one can easily get skilled therein. But, on the contrary, if the whetting work requires simultaneously more than two motions and these motions must be carried out by feeling, it will be quite difficult to get skilled in whetting knives, which is the same experience we all have had in our every day life.

Accordingly, if even a mechanical or electrically driven knife whetting device or machine requires simultaneously several complicated motions of the users, they can not easily get skilled in using thereof, which usually results in that the knife blade becomes spoilt and useless.

The object of the present invention is to provide an improved knife whetting machine which can simplify the simultaneous whetting motions by feeling, in order to ensure the accurate and convenient knife whetting operation without fail.

There has been a prior electrically driven knife whetting machine in the Japanese Utility Model Gazette No. 1978-113489 which consists of a grindstone mounting assembly comprising a coupling means having a spring(-spiral) inside thereof and being mounted on the upper part of the motor shaft, and a grindstone holder being elastically moved up and down by said spring.

When whetting a knife on said prior knife whetting machine, one must first place the knife on the fixed knife blade guiding plate and then press its blade against the inclined surface of the rotating grindstone by uniformly applying pressure thereto by hand, but the blade is apt to be ground deeply or slightly (too much or too little) according to the pressure applied thereto. And thirdly, one must simultaneously pull and push the knife along the fixed knife blade guiding plate slidingly forward and backward in the longitudinal direction by maintaining a continuous contact between the blade and the inclined surface of the rotating grindstone, i.e. one must not only press the blade against the fixed knife blade guiding plate but also apply a uniform pressure against the inclined surface of the grindstone at the same time and also simultaneously push and pull the knife forward and backward. The above three motions must be carried out simultaneously by feeling. Accordingly, the blade may be whetted accurately or inaccurately according to the accurateness of said three motions.

However, it is quite difficult to press the blade against the inclined surface of the rapidly rotating grindstone with a uniform pressure, and the whetting work will often result in failure. In said prior art, one of the major causes of failure in whetting knife blades is attributed to the fact that it is almost impossible to uniformly press the blades against the inclined surface of the grindstone.

One of the important advantage of the present invention is that the knife blade can be contacted with the plane surface of the grindstone at a very small angle.

BRIEF DESCRIPTION OF DRAWINGS

The preferred embodiments in accordance with the present invention will now be more particularly described with reference to the accompanying drawings wherein.

DESCRIPTION OF THE PREFERRED EMBODIMENTS

Figure 1:
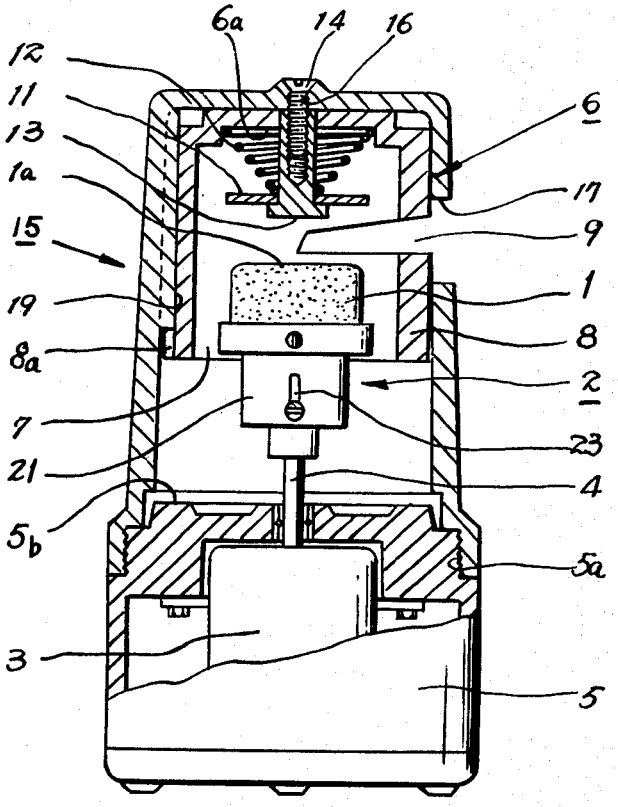
FIG. 1 is a sectional view of an embodiment in accordance with the present invention.

Referring to FIG. 1, the knife whetting machine of the present invention comprises a grindstone 1 mounted on a grindstone holder 2 which is a part of the grindstone rotating assembly installed securely on the motor shaft 4, a electric motor 3 contained in a motor housing 5 and a knife blade regulating and guiding means 6 elastically attached to the upper cover 15 above the motor housing 5, the upper cover 15 being threadingly secured on the motor housing 5 at the peripheral edge 5*a*, said knife blade regulating and guiding means 6 being characterized in that it moves slidingly up and down within the upper cover 15 by the elasticity of a spring 12 as will be described hereinafter and it enables the knife blade to contact with the plane surface 1*a* of the rotating grindstone 1 at an almost horizontal angle (very small angle).

The construction of said knife whetting machine will now be described in greater detail as follows:

Referring to FIGS. 1 to 4, the knife blade regulating and guiding means 6 is shaped like an upside-down cup having an empty inside 7 to cover the grindstone 1 together with the grindstone rotating assembly, said means 6 having a knife blade guide opening 9 of a given angle and size provided on the cylinderical wall 8 of said means 6 through which a knife blade to be whetted is inserted. Said means 6 is further provided with a vertical guide groove 8*a* on the outer surface of its cylinderical wall 8, said groove 8*a* being engaged with a vertically elongated protrusion 19 on the cylinderical inner surface of the upper cover 15 as will be explained hereinafter in order to prevent said means 6 from rotating laterally. Said means 6 is further provided with a pair of holes 10*b* symmetrically located on the peripheral step or recess 10*a* on the top of the ceiling plate 6*a* through which a pair of spring-loaded conductive rods 26 are inserted.

As illustrated in FIG. 1, said knife blade regulating and guiding means 6 is elastically fastened to the inner side of the ceiling plate 15*a* of the upper cover 15 by means of a spring assembly consisting of a conical coil spring 12, a spring holder or retainer 11, a bushing 13 and a fastening screw 14 being screwed through the ceiling center hole 16 and threaded into the bushing 13.

There can be several embodiments of the present invention according to the variations in the formation of the upper cover 15, which will be described in detail as follows:

In the embodiment of the present invention according to FIGS. 1 to 5, the knife blade regulating and guiding means 6 is slidingly moved up and down within the upper cover 15 having an opening 17 through which the knife blade is inserted into the knife blade guide opening 9 of the knife blade regulating and guiding means 6. In order to enable said means 6 to move upward and downward and to prevent it from rotating laterally, there are provided on the inner surface of the cylinderical wall 18 of the upper cover 15 one or more vertically elongated protrusions 19 which are engaged with the vertically elongated guide grooves 8*a* provided on the outer surface of the cylinderical wall 8 of said knife blade regulating and guiding means 6. The numbers of said elongated grooves 8*a* and protrusions 19 are not limited.

Figure 3A:
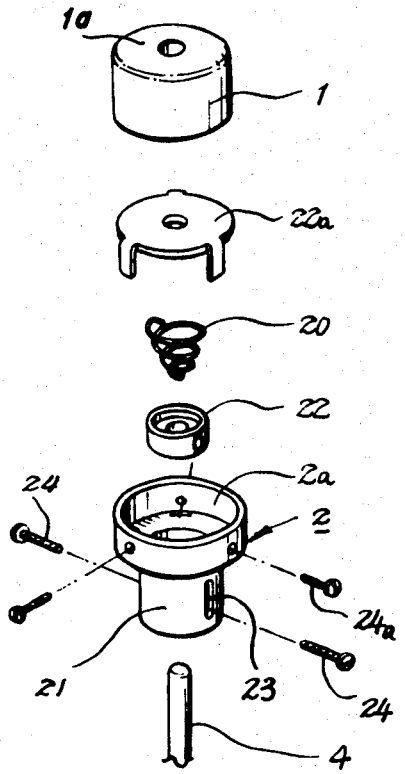
FIG. 3(*a*) is an exploded perspective view showing the grindstone rotating body assembly of the present invention, and FIG. 3(*b*) is a sectional view showing the assembled grindstone rotating body assembly of FIG. 3(*a*)
Figure 3B:
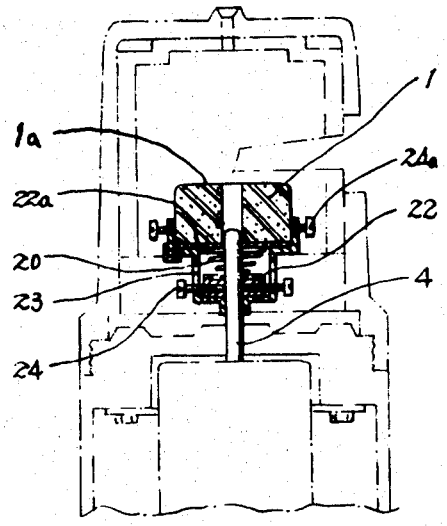

Referring to FIG. 3*a*, the grindstone rotating assembly consists of a grindstone holder 2 formed intergrally on its upper portion for mounting the grindstone 1, a cylinderical spring housing 21 formed integrally on its lower portion for housing the conical coil spring 20, a washer or spring retainer 22*a* located between said spring 20 and the grindstone 1 for facilitating the smooth expansion and contraction of said spring 20 and a cylinderical lock member 22 located under the spring 20 in the lower part of the spring housing 21 for coupling the motor shaft with the grindstone rotating assembly and retaining said spring 20 at the same time, said lock member being secured to the motor shaft 4 by means of the screws 24 which are slidingly passed through the vertically elongated openings 23 provided on the side wall of said cylinderical spring housing 21 and threaded through the holes provided on the side wall of said cylindrical lock member 22 and securely fastened to the motor shaft 4, so that said cylindrical spring housing 21 can be moved up and down by means of said spring 20. The grindstone is secured within the grindstone holder 2 by means of the securing screws 24*a* as shown in FIG. 3(*b*).

Thus, the entire grindstone rotating assembly is coupled with the motor shaft 4 whereby it is rotated by the motor 3 and also moved upward and downward by the pressure applied to the rotating grindstone.

Figure 2:
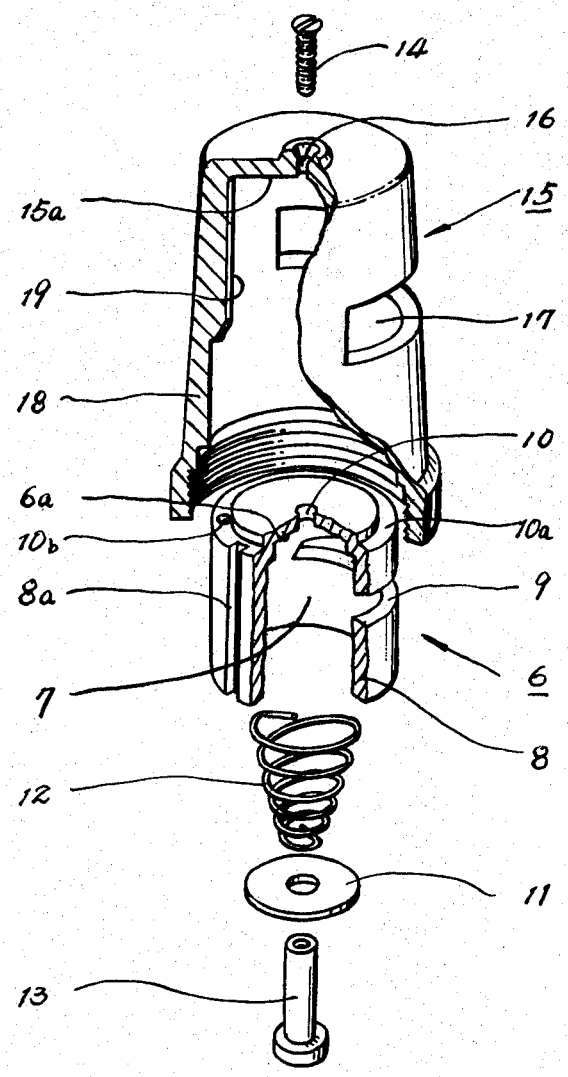
FIG. 2 is a perspective view with a partially cutaway sectional illustration of the exploded component parts forming the knife blade regulating and guiding means of the present invention.
Figure 4A:
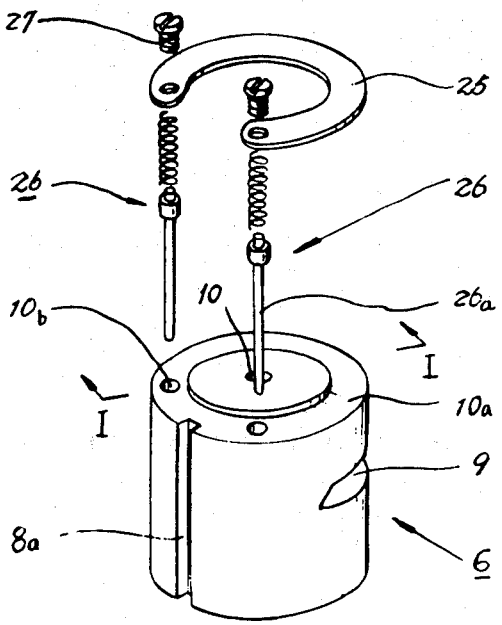
FIG. 4(*a*) is an exploded perspective showing two spring-loaded conductive rods of the knife blade regulating and guiding means of FIG. 2, and FIG. 4(*b*) is a sectional view of the assembled knife blade regulating and guiding means taken along the line I—I of FIG. 4(*a*).
Figure 4B:
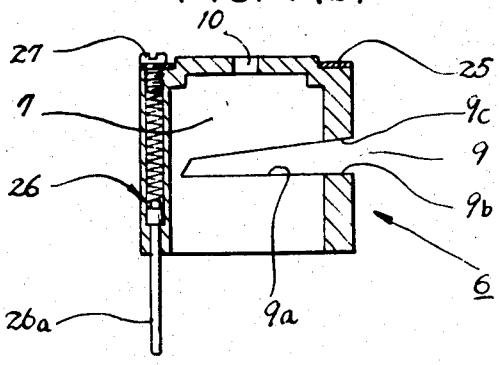
Figure 5:
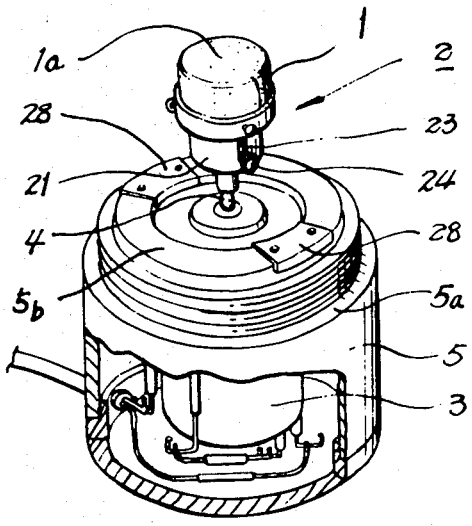
FIG. 5(*a*) is a perspective view showing the grindstone rotating body assembly mounted on the motor shaft, and FIG. 5(*b*) is a block diagram of the automatic electrical system comprising two spring-loaded conductive rods, two switch terminals and a motor driving the grindstone rotating body assembly of FIG. 5(*a*)
Figure 5:
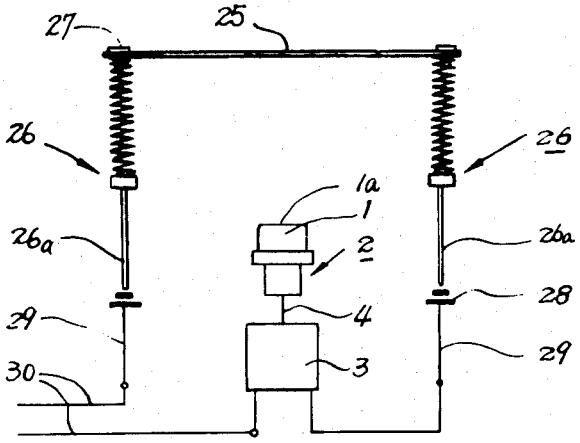

Referring to FIGS. 4 to 5, another advantage of this embodiment in accordance with the present invention will be described as follows: As shown in FIG. 4(*a*), when providing the knife whetting machine with the automatic switch system, a semi-annular conductive ring 25 is mounted on the perpheral recess or step 10*a* and securely connected to both spring-loaded terminals 26 by means of the screws 27 (FIG. 4(*b*)), said spring-loaded terminals having the conductive rods 26*a* respectively which will be contacted with respective conductive plates 28 provided on the periphery 5*b* on the top of the motor housing 5 (FIG. 5(*a*)) whereby the motor 3 will be energized or disenergized. In this embodiment the motor housing 5, guide means 6 and upper cover 15 are all formed of a non-conductive material. In the drawing 5(*b*), the reference No. 29 indicates the circuit wires and No. 30 refers to the power line. In case of employing the manual switch system, it is not necessary to provide the peripheral step or recess 10*a* and the terminal holes 10*b* on the knife blade regulating and guiding means 6 as shown in FIG. 2.

Figure 6:
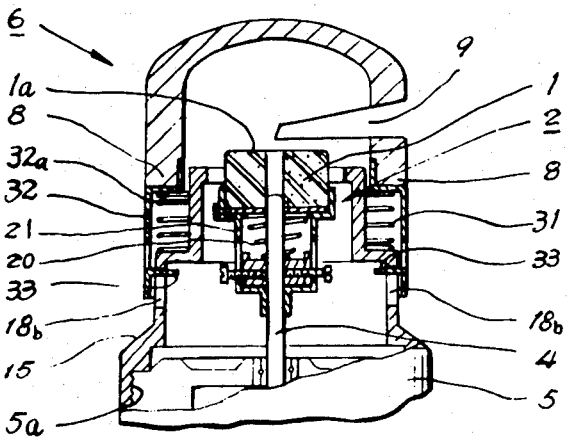
FIG. 6 is a sectional view of another embodiment in accordance with the present invention.
Figure 7:
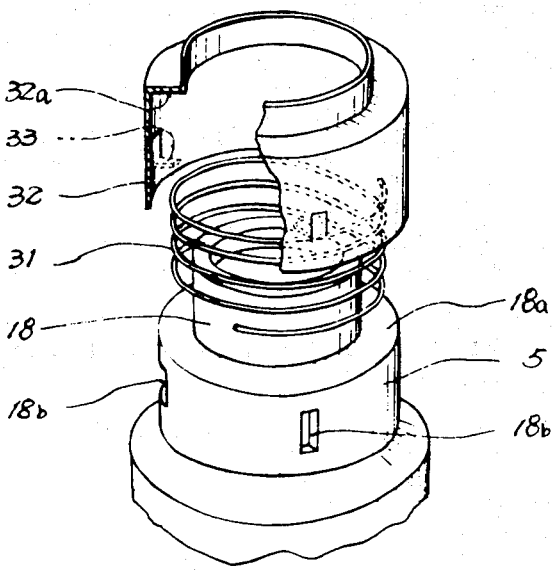
FIG. 7 is an exploded perspective view showing the major component parts of FIG. 6.

Another embodiment of the present invention will be now described in reference to FIGS. 6 and 7.

In this embodiment, the cylinderical knife blade regulating and guiding means 6 is designed to cover the upper cover 15 wherein a spiral spring 31 is provided between the stepped lower end 32*a* of said means 6 and the stepped periphery 18*a* of the upper cover 15, so that said means 6 can be moved elastically upward and downward. The cylinderical wall 8 of said means 6 can be further extended from the stepped lower end 32*a* by being formed thinly, but alternatively, a formed metal cylinder 32 having the stepped end 32*a* may be bonded or screwed securely to the lower end of said means 6. The cylinderical wall 18 of the upper cover 15 is bent to the inner side thereof to form the stepped periphery 18*a* and then extended further upward.

In order to guide both cylinderical wall 32 and 18 for the sliding movement by contacting with each other, there are provided one or more protrusions 33 on the inner surface of said means 6 and one or more corresponding vertically elongated guide grooves 18*b* on the outer surface of the upper cover 15. Said guide protrusions 33 and grooves 18*b* may be provided on either walls of said means 6 and upper cover 15 and vice versa, and the numbers thereof are not limited.

Accordingly, in the above alternative embodiment, the knife blade regulating and guiding means 6 serves in fact as an upper housing. And it is therefore not necessary to provide the vertically elongated grooves 8*a*, the peripheral step or recess 10*a*, the terminal holes 10*b* for the springloaded conductive rods 26 and the center ceiling hole 10 of said means 6 as the first embodiment as shown in FIGS. 2, 3 & 4, and on the contrary thereto, a manual switch (not particularly described) will be used in this alternative embodiment.

In order to make sure of the operation and effect of the present invention, the operation thereof will be explained in detail in reference to FIGS. 8 and 9 of the accompanying drawings by comparing the present invention with the prior art in FIG. 10.

Figure 10:
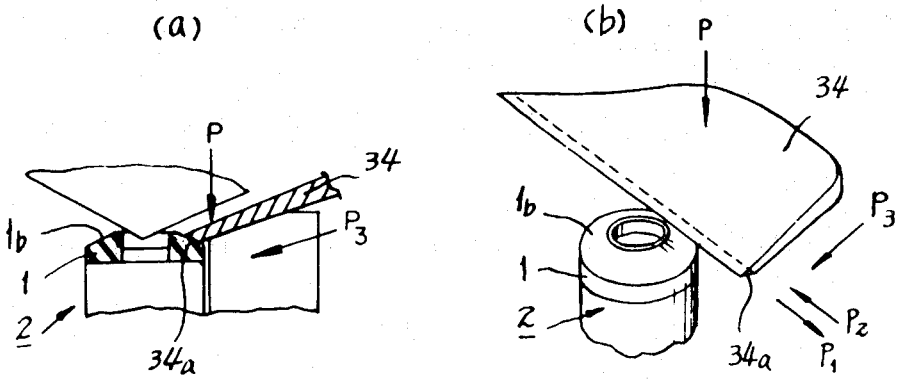
FIG. 10(*a, b*) are the explanatory views illustrating the operation of the prior knife whetting machine.

According to the prior knife whetting machine as shown in FIG. 10, the inclined edge 34*a* of the blade 34 is pressed against the inclined surface 1*b* on the top of the rotating grindstone 1 (for example: the inclined surface of the grindstone is usually identical with the inclined edge of the knife blade.) by simultaneously applying the pressure P pressing down the blade 34 onto the guide plate and the pressure P3 pressing the blade 34 onto the inclined surface 1*b* of the grindstone 1 and at the same time, the knife is pulled or pushed forward P1 and backward P2 whereby these three motions must be carried out simultaneously by feeling. Therefore, it is quite difficult for the users to get skilled in employing said prior knife whetting machine.

In the operation of said knife whetting machine of the present invention, after turning on the power switch in case of the manual switch system, simply place the knife blade 34 onto both side edges 9*a* of the knife blade regulating and guiding opening 9 by ensuring a good contact therebetween and press the knife downward whereby the conductive rods 26*a* of the spring-loaded switch terminals 26 are electrically connected to the conductive plates 28 and the grindstone begins to rotate.

Figure 8:
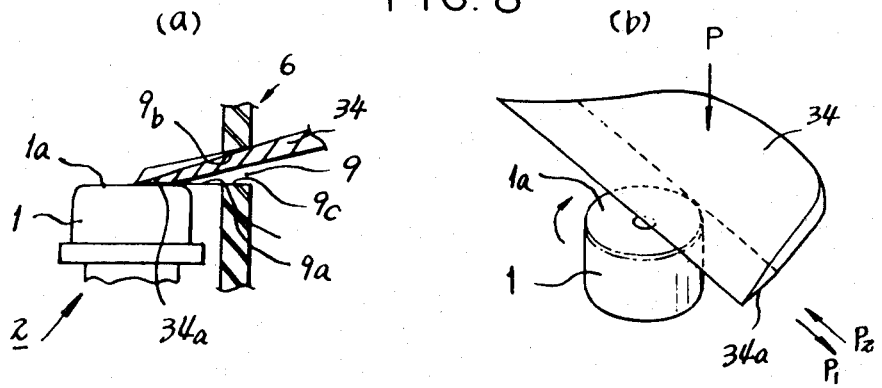
FIGS. 8(*a, b*) and 9(*a, b*) are the explanatory views showing the operations of the knife whetting machine of the present invention.
Figure 9:
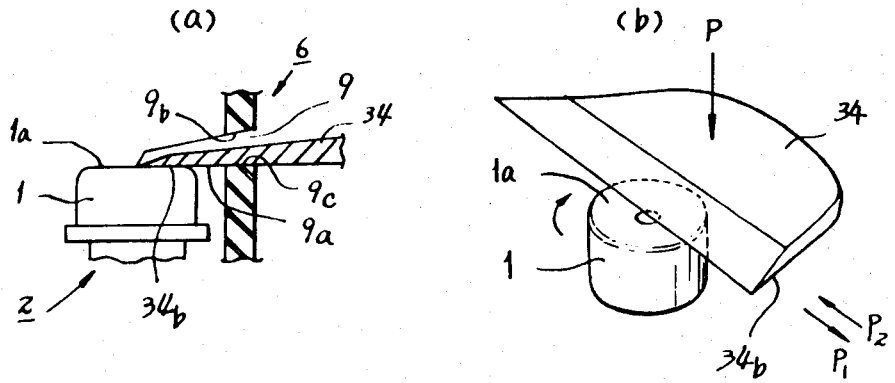

The knife blade 34 will be sharpened according to the pressure applied when placing the inclined surface 34*a* of the blade 34 onto the plane surface 1*a* of the grindstone 1 at almost a horizontal angle (for example: by pressing the upper rear part of the blade 34 onto the upper jaw 9*b* of the blade guiding opening 9 as illustrated in FIG. 8(*a*)) or when placing the plane surface 34*b* of the blade 34 onto the plane surface 1*a* horizontally (for example: by pressing the lower rear part of the blade 34 onto the lower jaw 9*a* as illustrated in FIG. 9(*a*)). In the whetting operation above, while maintaining the vertically applied pressure P by placing the blade 34 onto the both side edges 9*a*, the blade 34 is pulled in the direction of the arrows P1 and P2, wherein the two motions above are carried out simultaneously, and thus, one can relatively easily get skilled in whetting knives and the whetting operation can be accurately performed.

Said blade 34 can be sharpened by applying the vertical pressure P and at the same time pulling or pushing the blade 34 forward P1 and backward P2 in the direction of the longitudinal axis of said blade 34.

If it gives a feeling that the vertical pressure P is excessive, and as soon as the pressure applied is loosened, the blade 34 will be separated from the grindstone 1 by the elasticity of the spring 12 and 31 of the knife blade regulating and guiding means 6, so that the contact pressure of the blade 34 can be regulated instantaneously, and accordingly, it will not happen that the knife blade 34 is overground and becomes spoilt. Accordingly, the present invention provides a safe and reliable knife whetting machine.

Furthermore, it may be also possible to let said knife whetting machine move along said knife blade in the longitudinal direction thereof after fixing said knife in the horizontal position.

If the pressure P applied to the blade 34 is somewhat excessive or uneven, the contact pressure will be regulated by the buffer action of the spring 20 mounted under the grindstone holder 2, and although there are usually some differences between the whetting degrees, the blades 34 will not be overwhetted. Accordingly, when the whetting motions described above are repeated, the blades 34 can be well whetted.

The present invention provides a convenient and reliable knife whetting machine wherein the knife blade 34 can be safely and accurately whetted without fail, characterized by the knife blade regulating and guiding means 6 which is capable of regulating the user's motions more accurately by the elasticity of the springs 12 and 31 and of the spring 20 and thus capable of better regulating the contact pressure applied to the knife blade 34 to be whetted by employing the buffer actions of the springs 12 and 31 of said knife blade regulating and guiding means 6 and of the spring 20 of the grindstone 1 when the knife blade 34 is pressed onto the plane surface 1*a* on the top of the grindstone 1 by contacting with each other at almost horizontal angle or at less than 10 degrees.

I claim:

1. An electrically driven knife whetting machine comprising:

an electric motor having a rotating shaft;

said electric motor being contained in a motor housing with said shaft extending out of said motor housing;

a grindstone rotating assembly securely mounted on said shaft, said assembly including a grindstone mounted on a grindstone holder, said grindstone having a top grinding surface;

a cylindrical upper cover securely mounted on said motor housing;

a knife blade regulating and guiding means being cylindrically shaped like an upside-down cup for receiving said grindstone therein, said cup having a knife blade guiding opening of a given angle and size provided in a cylindrical wall thereof, said guiding opening being disposed above said grindstone;

first means for elastically moving said cup relative to said upper cover so that said guiding opening can be moved up and down with respect to said grindstone;

second means for preventing said cup from being laterally rotated with respect to said upper cover;

said cup being located above said grinding surface and being substantially covered by said upper cover;

a bushing being attached to an inside ceiling of said upper cover, said bushing extending through an opening in a ceiling of said cup; and said first means for elastically moving said cup being located around said bushing between an end of said bushing and said ceiling of said cup to bias said cup away from said grinding surface.

2. An electrically driven knife whetting machine as in claim 1, wherein said first means includes a spring disposed against said cup to bias said cup upwardly away from said grindstone.

3. An electrically driven knife whetting machine as in claim 2, wherein said second means include vertically elongated grooves provided in one of said cup and upper cover, and protrusions provided on the other of said cup and upper cover, said protrusions being engagingly received in said grooves to prevent rotation therebetween while permitting vertical sliding movement therebetween.

4. An electrically driven knife whetting machine as in claim 1, wherein a semi-annular conductive ring is provided on a peripheral upper surface of said cup, and two spring-loaded conductive terminals are inserted into respective terminal holes in said cup in contact with said conductive ring, said conductive terminals being movable into contact with conductive plates provided on said motor housing to start said electric motor.

5. An electrically driven knife whetting machine as in claim 1, wherein said second means include elongated guide grooves provided longitudinally in said cup cylinderical wall, and vertical protrusions provided on an inner surface of said upper cover, said protrusions being engagingly received in said grooves to prevent rotation therebetween while permitting vertical sliding movement therebetween.

6. An electrically driven knife whetting machine comprising:

an electric motor having a rotating shaft;

said electric motor being contained in a motor housing with said shaft extending out of said motor housing;

a grindstone rotating assembly securely mounted on said shaft, said assembly including a grindstone mounted on a grindstone holder, said grindstone having a plane top surface;

a cylindrical upper cover securely mounted on said motor housing;

a knife blade regulating and guiding means being cylindrically shaped like an upside-down cup for receiving said grindstone therein, said cup having a knife blade guiding opening of a given angle and size provided in a cylindrical wall thereof, said guiding opening being disposed above said grindstone;

first means for elastically moving said cup relative to said upper cover so that said guiding opening can be moved up and down with respect to said grindstone;

second means for preventing said cup from being laterally rotated with respect to said upper cover;

said first means including a spring disposed against said cup to bias said cup upwardly away from said grindstone;

said cup being disposed within said upper cover; and a semi-annular conductive ring being provided on a peripheral upper surface of said cup, and two springloaded conductive terminals being inserted into respective terminal holes in said cup in contact with said conductive ring, said conductive terminals being movable into contact with conductive plates provided on said motor housing to start said electric motor.

7. An electrically driven knife whetting machine as in claim 6, wherein said spring is disposed around a bushing extending through a ceiling of said cup, said bushing being secured by a fastening screw to a ceiling of said upper cover, a spring holder maintains said spring on said bushing against said cup ceiling.

8. An electrically driven knife whetting machine as in claim 7, wherein said second means include elongated guide grooves provided longitudinally in said cup cylinderical wall, and vertically elongated protrusions provided on an inner surface of said upper cover, said protrusions being engagingly received in said grooves to prevent rotation therebetween while permitting verical sliding movement therebetween.

9. An electrically driven knife whetting machine as in claim 6, wherein said second means include vertically elongated grooves provided in one of said cup and upper cover, and protrusions provided on the other of said cup and upper cover, said protrusions being engagingly received in said grooves to prevent rotation therebetween while permitting vertical sliding movement therebetween.

* * * * *